United States Patent [19]

Bayless et al.

[11] 3,949,260

[45] Apr. 6, 1976

[54] CONTINUOUS IONIZATION INJECTOR FOR LOW PRESSURE GAS DISCHARGE DEVICE

[75] Inventors: John R. Bayless, Malibu; Robin J. Harvey, Thousand Oaks, both of Calif.

[73] Assignee: Hughes Aircraft Company, Culver City, Calif.

[22] Filed: Apr. 14, 1975

[21] Appl. No.: 567,975

[52] U.S. Cl. ..... 313/157; 313/161; 313/198

[51] Int. Cl.[2] ..... H01J 23/10

[58] Field of Search ..... 313/157, 161, 162, 198

[56] References Cited

UNITED STATES PATENTS 3,890,520 6/1975 Lutz et al. ..... 313/157

*Primary Examiner*—R. V. Rolinec
*Assistant Examiner*—Darwin R. Hostetter
*Attorney, Agent, or Firm*—Allen A. Dicke, Jr.; William H. MacAllister, Jr.

[57] ABSTRACT

Plasma chamber maintained ionized by thin wire discharge continuously supplies ionized plasma into the interelectrode space of a low pressure gas discharge device such as a crossed-field switch tube to eliminate dependence on statistical electrons for initiation of discharge.

6 Claims, 2 Drawing Figures

CONTINUOUS IONIZATION INJECTOR FOR LOW PRESSURE GAS DISCHARGE DEVICE

The invention herein described was made in the course of or under a contract with the United States Navy.

BACKGROUND OF THE INVENTION

This invention is directed to a continuous plasma injector for providing ionized gas into the interelectrode space of a low pressure gas discharge device.

Crossed-field switching devices have been known for many years as laboratory curiosities, as shown in Penning U.S. Pat. No. 2,182,736; and as simple low power devices, as shown in Boucher U.S. Pat. Nos. 3,215,893 and 3,215,939 and Wasa U.S. Pat. No. 3,405,300.

Only recently, however, has the utility of such a switching device in high voltage, high current DC applications been recognized, becuase careful design is necessary for employment of the crossed-field device concept in high current and high voltage situations. Examples of such use are found in Kenneth T. Lian U.S. Pat. No. 3,534,226 and Gunter A. G. Hofmann and Ronald C. Knechtli U.S. Pat. No. 3,538,960.

When onswitching a crossed-field switch device, both an electric field and a magnetic field are applied so that breakdown of the interelectrode gas can take place. This requires an initial electron or ion to start the avalanche. Such particles are always present on a statistical basis due to random cosmic ray events. G. A. G. Hofmann U.S. Pat. No. 3,714,510 also describes the onswitching conditions and employs a plasma puffer to eliminate the wait for the initial particle. Another approach is to use a radioactive source. Another method of creating the necessary ionization is to use a field emitter for electrons, see U.S. Pat. 3,890,520, but field emitters require comparatively high voltage and are subject to sputtering damage. The structure of this invention provides a continuous plasma source using a cold cathode glow discharge employing a thin wire anode.

SUMMARY

In order to aid in the understanding of this invention it can be stated in essentially summary form that it is directed to a continuous plasma source for a low pressure gas discharge device such as a crossed-field switch tube, the source being a cold cathode glow discharge source having a thin wire anode to provide ionized gas to the interelectrode space of the crossed-field switch tube.

It is thus an object of this invention to provide an economic, reliable and safe device of long life and free of sputtering damage for providing ionized gas into the interelectrode space of a crossed-field tube or other low pressure gas discharge device to reliably permit the ignition thereof.

It is another object to reduce the statistical time lag to less than 1 microsecond so that precise ignition with low (sub microsecond) shot-to-shot variation in firing is possible, by providing charged particles to the interelectrode space.

It is a further object to provide a low pressure glow discharge device attached to the interelectrode space of a crossed-field switch tube which in addition to supplying plasma to the interelectrode space, can also act as an ion pump and can act as a pressure gage.

Other objects and advantages of this invention will become apparent from a study of the following portion of this specification, and the claims taken in conjunction with the accompanying drawings.

DESCRIPTION

Figure 1:
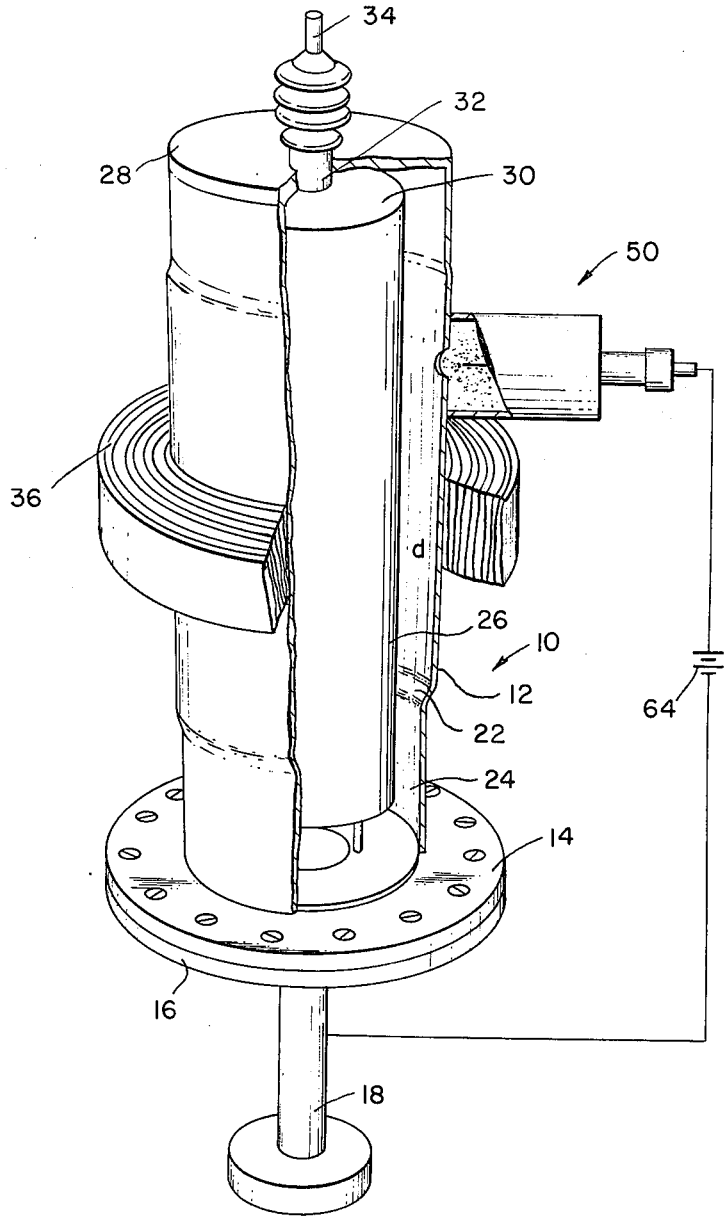
FIG. 1 is a side elevational view of a crossed-field switch tube, with parts broken away and parts taken in section showing the interelectrode space and showing the plasma device secured to discharge ions and electrons into the interelectrode space.
Figure 2:
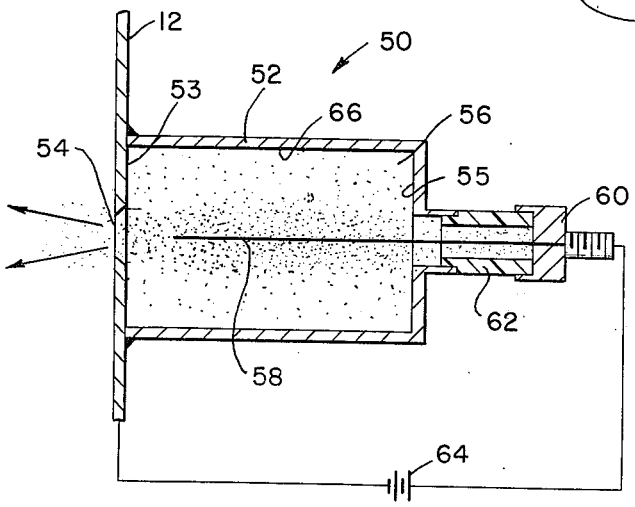
FIG. 2 is an enlarged section through the low pressure cold cathode glow discharge igniter.

In order to fully appreciate the igniter device, as an igniter for a low pressure gas discharge device, some understanding of the crossed-field switch device 10 as an example of a low pressure gas discharge device is required. It comprises housing 12 which is carried upon bottom flange 14. Bottom flange 14 is, in turn, mounted upon base flange 16 and they are secured together to provide a tight seal. Base flange 16 stands upon foot 18 for supporting the switch device structure. Furthermore, foot 18 can act as a vacuum connection for drawing a suitable vacuum on the interior of housing 12 and then letting into the housing the desired gas (e.g., helium or hydrogen, including its isotope deuterium) at the required pressure. Housing 12, together with bottom flange 14, serves as a suitable vacuum tight envelope. Cathode 12 is metallic and can be made of stainless steel. The cathode is connected to the foot 18, such as by metallic continuity. Thus, foot 18 provides one of the electrical connections to the switching device 10. Cathode 12 may have an axial slot to prevent the circumferential circulation of current during switching transients when the axial magnetic field changes with time.

Anode 26 is of cylindrical tubular construction and is positioned concentrically with cathode 12 to provide a radial space therebetween having the dimension *d*. The radial space *d* is substantially equal at all facing positions of the anode and cathode. Housing 12 has a top cap 28 upon which anode 26 is positioned. The anode is maintained in position by employing anode cap 30 which is secured to the cylindrical anode 26 and, in turn, carries mounting stud 32. Mounting stud 32 provides both mechanical supporting by being secured to housing cap 28 and provides electrical continuity through the cap by electrical connector 34. Preferably, anode cap 30 is spaced below top cap 28 and connector 34 passes through insulative mounting stud 32 so that connector 34 and the entire anode are electrically separated from the housing. Alternatively, top cap 28 can be of insulative material.

Anode 26 may be perforated so that the interior space thereof serves as a gas volume to supply gas to the interelectrode space. Furthermore, gas supply means can be provided interiorly of the anode to supply gas as it is consumed by glow discharge in the interelectrode space. Both of these concepts are taught in Hofmann and Knechtli U.S. Pat. No. 3,558,960. The maintenance of interelectrode space gas pressure is discussed in more detail in that patent.

Magnet 36 is positioned on the exterior of housing 12 in such a manner as to provide magnetic lines of force in the interelectrode space which are substantially parallel to the axis of the electrodes of switching device 10 over at least part of the electrode length. Magnet 36 is illustrated as being an electromagnet and such is preferred so that the magnetic field can readily be switched on and off. The power supply to magnet 36 is preferably of such nature as to provide for rapid turn on and off of the field. Its strength is such as to provide a field of about 100 gauss for off-switching alone and about 1 kilo gauss for on-switching against high voltages (up to 100 kv).

Once a glow discharge is established between electrodes 12 and 26 and current is flowing, off-switching is accomplished by reducing the magnetic field strength in the interelectrode space to a point where cascading ionization cannot continue (typically to less than 50 gauss). Thus, conduction ceases. This is explained in considerably more detail in the Hofmann and Knechtli U.S. Pat. No. 3,558,960 mentioned above.

In the absence of an applied magnetic field, the electrical breakdown of a gas at a pressure *p*, contained between two electrodes of spacing *d*, is governed by the Paschen curve for the specific gas in use. To remain in the nonconducting state under a given applied voltage, it is necessary to adjust the *pd* product of a crossed-field switch to fall to the left of the Paschen curve for that specific device. It is difficult to initiate a crossedfield discharge if the pressure is much below 50 millitorr, so this sets an upper limit on the interelectrode spacing of about 4 centimeters for helium. The minimum electrode spacing is fixed by the requirement that vacuum breakdown will not occur at the maximum voltage level. Several experiments indicate that a spacing of at least 1.5 centimeters is necessary to hold off 100 kilovolts. Thus, for a tube to remain in the nonconducting state under the influence of an applied high voltage, the interelectrode space must be kept between well-defined limits. The upper limit is determined by Paschen breakdown; and the lower limit, by vacuum breakdown.

When the device is in the nonconducting state, the electron mean-free path for an ionizing collision is much greater than *d*. Consequently, electrons which appear in the interelectrode space are lost at a rate that is too high for a gas discharge to be formed and sustained. Applying a sufficiently large magnetic field with one component perpendicular to the electric field, however, causes these electrons to remain in the interelectrode space for a considerably longer time. As a result, they can then make a sufficient number of ionizing collisions in spite of the low gas pressure, and a high density gas discharge can be formed (e.g., application of the magnetic field is, in effect equivalent to increasing the pressure). For ignition to occur at an acceptably low value of magnetic field, it is customary to employ a coaxial, cylindrical electrode arrangement because coaxial, cylindrical electrodes serve as an ideal trapping means.

The number of ampere turns necessary to trigger a crossed-field switch depends on the applied voltage and the field coil/electrode geometry. For a typical tube holding off 100 kilovolts, this is not excessive; it is only slightly greater than 2,000 ampere turns. The energy stored in the magnetic field at this level is approximately 1 to 10 joules.

Ignition jitter is defined to be the shot-to-shot variation in the time when current initiation occurs. This jitter must be within certain allowable limits which are determined by circuit and system requirements. In an idealized system, current initiation will occur at the time when the electric and magnetic fields reach the required values for ignition (i.e., there is electron trapping). In a real system, ignition can be delayed beyond this time, if there is a lack of initiatory charged particles.

Igniter 50 has a tubular outer housing 52 which is secured to the outside of envelope 12 which is the cathode of the crossed-field switch device 10. Opening 54 in the envelope permits the interior space 56 of the igniter to be in communication with the interelectrode space d. Housing 52 is closed at its inner end by end wall 53 which is part of the cathode 12. It is closed on its outer end by outer end wall 55. Thus, the atmosphere within the interelectrode space is in communication with the interior of the igniter. The discharge of the crossed-field device is characterized by its low pressure and low voltage operation. The pressure ranges from $10^{-3}$ to $10^{-1}$ torr. The discharge voltage is in the 300 volt range. Helium is a convenient gas in the interelectrode space *d*. This helium is communicated through the interior space 56 of the igniter.

Igniter 50 has an interior thin wire 58. Thin wire 58 is supported on cap 60 which in turn is mounted upon insulator 62 secured to end wall 55 on outer housing 52. The entire exterior of the structure is closed to permit maintenance of the low pressure in the interelectrode space and the interior of igniter 50. Wire 58 is typically less than 1 millimeter in diameter and is preferably about 0.2 millimeters in diameter.

Power supply 64 is connected between wire 58 and envelope 12 with such a polarity as to make thin wire 58 positive to serve as an anode with the tubular housing 52 negative so that the interior surface 66 acts as the active surface of the cathode. Power supply 64 supplies about 500 volts and has the usual internal resistance to provide discharge stability.

When the anode voltage is supplied to the thin wire 58, any electron existing within space 56 (for example due to cosmic ray ionization) will be attracted toward the anode. Under practical conditions having the small diameter wire anode, such as initial electron under the influence of the electric field in the near vacuum will be accelerated toward anode wire 58 but will have a high probability to miss it due to its angular momentum. Under these circumstances it becomes trapped in an orbit around this anode wire due to the electric potential well around the wire until it has made a number of ionizing collisions with the gas in the space 56. Such collisions result in the formation of a plasma. Ions produced in that way are attracted to the active cathode surface 66 where they release electrons just as in a standard cold cathode discharge. In this way the cold cathode discharge is established in the igniter 50. The ability of this discharge to operate at low pressures is a result of the highly efficient containment of electrons in the electro-static potential well of the wire. The required operating voltage increases as the wire diameter increases and with the preferred wire diameter of 0.2 milimeters a discharge voltage of 300 volts is expected.

With the maintenance of the discharge in region 56, a sufficient number of charged particles are discharged through opening 54 to maintain sufficient pre-ionization in interelectrode space *d* to reduce the statistical lag of initiation of the discharge in crossed-field switch 10 to a minimum level. The operational voltage of igniter 50 is an order of magnitude lower than the operating voltage of a sharp point electron emitter.

The low voltage cold cathode discharge in space 56 is sensitive to magnetic fields. Shielding, from the magnetic field of the crossed-field tube 10, if required, is easily accomplished by forming the tubular outer housing 52 from iron or from a highly electrically conductive material such as copper. In the latter case, eddy currents flowing in the housing 52 which result from the large rate of change of the magnetic field associated with the crossed-field tube switch device during turn on will serve to shield the discharge in igniter 50 during the crossed-field tube ignition.

The cold cathode plasma discharge in igniter 50 has the capability of sensing the gas pressure in interior space 56. The capability results from the dependance of the discharge voltage on the gas pressure. With prior calibration, at a fixed discharge current the discharge voltage is calibrated against pressure, to result in the pressure measuring capability.

The present structure has a long life because the thin wire 58 is at anode potential. In sharp point electron emitters, sputtering of the sharp point causes the point to wear out.

In the present structure, the sputtering which results from the ion bombardment of the active cathode surface 66 results in the continuous formation of a surface which pumps chemically active gases. Chemically active gases found in this environment in small quantities are oxygen, nitrogen, hydrogen, carbon dioxide, $H_2O$ and others. The pumping action takes place where the material sputtered from regions of high plasma density, such as the interior of the cylindrical wall 66, is deposited on the cathode end wall surfaces 53 and 55 where the plasma density is low. Continuous pumping through aperture 54 will be obtained by continuously operating the discharge in space 56 at a low current level. Where the space 56 has a diameter of more than 2 centimeters and a length of more than 3 centimeters, at 1 milliamp the pumping rate for air is in the range of $10^{-5}$ - $10^{-4}$ torr.-liter/seconds.

Thus, the structure of the present igniter is of long life due to the fact that the thin wire anode is not subject to sputtering damage, and it operates on low voltage so that it serves as a desirable and useful structure by which electrons and ions are introduced into the interelectrode space of the crossed-field switch device.

With this operational status, the continuous electron injector can be operated continuously with the crossed-field switch tube circuit with an operating condition where the crossed-field switch tube may be called upon to go into conduction at any time. A circuit in which the crossed-field switch tube may be used is described in H. E. Gallagher and Wolfgang Knauer's Application Ser. No. 553,965 filed Feb. 28, 1975 for Bipolar Crossed-Field and Circuit. It is thus seen that the crossed-field switch tube is in a condition whereby it may be called upon to conduct at any time that the voltage and magnetic field are sufficient, for ignition. The igniter reduces the time for ignition and also reduces the difference in elapsed time from one start to the next, called jitter.

Each of the references to prior patents, publications and patent applications incorporates the entire subject matter of that reference herein in its entirety.

This invention having been described in its preferred embodiment, it is clear that it is susceptible to numerous modification and embodiments within the ability of those skilled in the art and without the exercise of the inventive faculty. Accordingly, the scope of this invention is defined by the scope of the following claims.

What is claimed is:

1. A crossed-field switch tube having an igniter, said crossed-field switch tube comprising:

a substantially cylindrical tubular cathode, a substantially cylindrical anode positioned within said cathode and defining an annular interelectrode space therebetween, said anode and said cathode being electrically insulated from each other and being connectable to a source of electrical potential, a gas at sub-atmospheric pressure within said interelectrode space, the gas pressure being such, in relation to the interelectrode space dimension, that the conditions are outside the conductive area of the Paschen curve, a magnet positioned to selectively provide a magnetic field in the interelectrode space so that in the presence of the magnetic field an electron in the interelectrode space is caused to annularly spiral in the annular interelectrode space to provide cascading ionization and conduction between said anode and said cathode, said igniter comprising:

a cold cathode plasma discharge chamber having a cathode surface, a thin wire anode mounted within said discharge chamber and spaced from said cathode, means for connecting an electric potential between said cathode surface and said thin wire anode, and an opening between said discharge chamber and said interelectrode space so that gas at subatmospheric pressure in said interelectrode space is in said discharge chamber, so that upon application of discharge voltage between said cathode surface and the thin wire anode a plasma discharge is produced in said plasma discharge chamber so that electrons and ions from the plasma discharge pass through the opening into the interelectrode space to produce initial ionization therein so that upon application of an interelectrode potential and an adequate magnetic field in the interelectrode space a crossed-field discharge is initiated.

2. The crossed-field switch of claim 1 wherein said anode of said cold cathode discharge chamber is a straight thin wire defining an axis and said active cathode surface is a wall which is tubular and is substantially cylindrical about said axis.

3. The crossed-field switch device of claim 2 wherein said opening from said discharge chamber into said interelectrode space lies substantially on said axis.

4. The crossed-field switch device of claim 2 wherein said discharge chamber has an end wall away from said cathode surface the discharge in said discharge space causing sputtering of material off said cylindrical discharge chamber cathode wall and deposition of sputtered material on the end wall of said discharge chamber to pump active gas.

5. The crossed-field switch tube of claim 4 wherein said end wall carries an insulator thereon and a cap is mounted on said insulator, said thin wire anode being mounted on said cap.

6. A low pressure gas discharge device having an igniter, said gas discharge device comprising:

a housing for maintaining a gas at sub-atmospheric pressure within said housing, a main anode and a main cathode spaced from each other within said housing for defining an interelectrode main discharge space, means on said housing for connecting at least an electric potential between said main anode and said main cathode for causing a low pressure ionized plasma discharge between said main anode and said main cathode in said main discharge space, said igniter comprising:

a cold cathode plasma discharge chamber having an ignitor cathode surface, a thin wire anode mounted within said discharge chamber and spaced from said ignitor cathode, means for connecting an electric potential between said ignitor cathode surface and said thin wire anode, and an opening between said discharge chamber and said interelectrode space so that gas at sub-atmospheric pressure in said interelectrode space is in said discharge chamber so that, upon application of discharge voltage between said ignitor cathode surface and said thin wire anode, a plasma discharge is ignited in said plasma discharge chamber so that electrons and ions from the plasma discharge pass through the opening into the interelectrode space to ignite initial ionization therein so that, upon connection of low pressure gas discharge conditions, a plasma discharge in said main discharge space is ignited.

* * * * *